US006758471B2

(12) United States Patent
Hirako

(10) Patent No.: US 6,758,471 B2
(45) Date of Patent: Jul. 6, 2004

(54) APPARATUS AND METHOD FOR SHEET TRANSPORT CONTROL

(75) Inventor: Naoki Hirako, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 75 days.

(21) Appl. No.: 10/289,356

(22) Filed: Nov. 7, 2002

(65) Prior Publication Data

US 2003/0173735 A1 Sep. 18, 2003

(30) Foreign Application Priority Data

Mar. 12, 2002 (JP) ..... 2002-067435

(51) Int. Cl.[7] ..... B65H 7/02
(52) U.S. Cl. ..... 271/258.01; 271/264; 271/265.01
(58) Field of Search ..... 271/258.01, 259, 271/264, 265.01, 265.02, 265.03; 270/58.04, 58.31, 58.32

(56) References Cited

U.S. PATENT DOCUMENTS 5,492,315 A * 2/1996 Maruyama et al. ..... 270/58.32
5,655,207 A * 8/1997 Sugiyama et al. ..... 399/382
6,053,495 A * 4/2000 Hara et al. ..... 271/263
6,076,821 A * 6/2000 Embry et al. ..... 271/10.01
6,311,972 B1 * 11/2001 Carter ..... 271/265.02
6,322,069 B1 * 11/2001 Krucinski et al. ..... 271/265.02
6,502,818 B1 * 1/2003 Nonaka et al. ..... 271/258.01
6,644,660 B2 * 11/2003 Sussmeier et al. ..... 271/270
6,702,274 B1 * 3/2004 Otsuka ..... 271/10.01
2001/0022422 A1 * 9/2001 Tamura ..... 271/10.03
2002/0130461 A1 * 9/2002 Petersen et al. ..... 271/258.01

FOREIGN PATENT DOCUMENTS

JP 8-245047 9/1996
JP 10-67458 3/1998

* cited by examiner

*Primary Examiner*—David H. Bollinger
(74) *Attorney, Agent, or Firm*—Morgan Lewis & Bockius LLP

(57) ABSTRACT

An image-forming apparatus allows duplex print to be performed using tabbed sheets. A plurality of paper sensors A, B, C, D, E, and F are installed on a paper output side of a paper tray 20 in a direction perpendicular to a sheet transport direction. The location of a tab 12 and the tab length in the transport direction are determined from a difference in timings of the rise or fall of output signals from the paper sensors A–F. When the tab 12 is located on the leading edge of the sheet in the transport direction and does not traverse a transport control sensor X, operation timing of a device α which is activated based on the timing of the rising of output signal from the transport control sensor X is advanced by an amount corresponding to the length of the tab 12. On the other hand, when the tab 12 traverses the transport control sensor X, or when a sheet without a tab is used, the operation timing is not advanced. Accordingly, it becomes possible to determine an appropriate operation timing even when a sheet is inverted or reversed for duplex printing.

17 Claims, 12 Drawing Sheets t=t1 t=t2 t=t1 t=t2

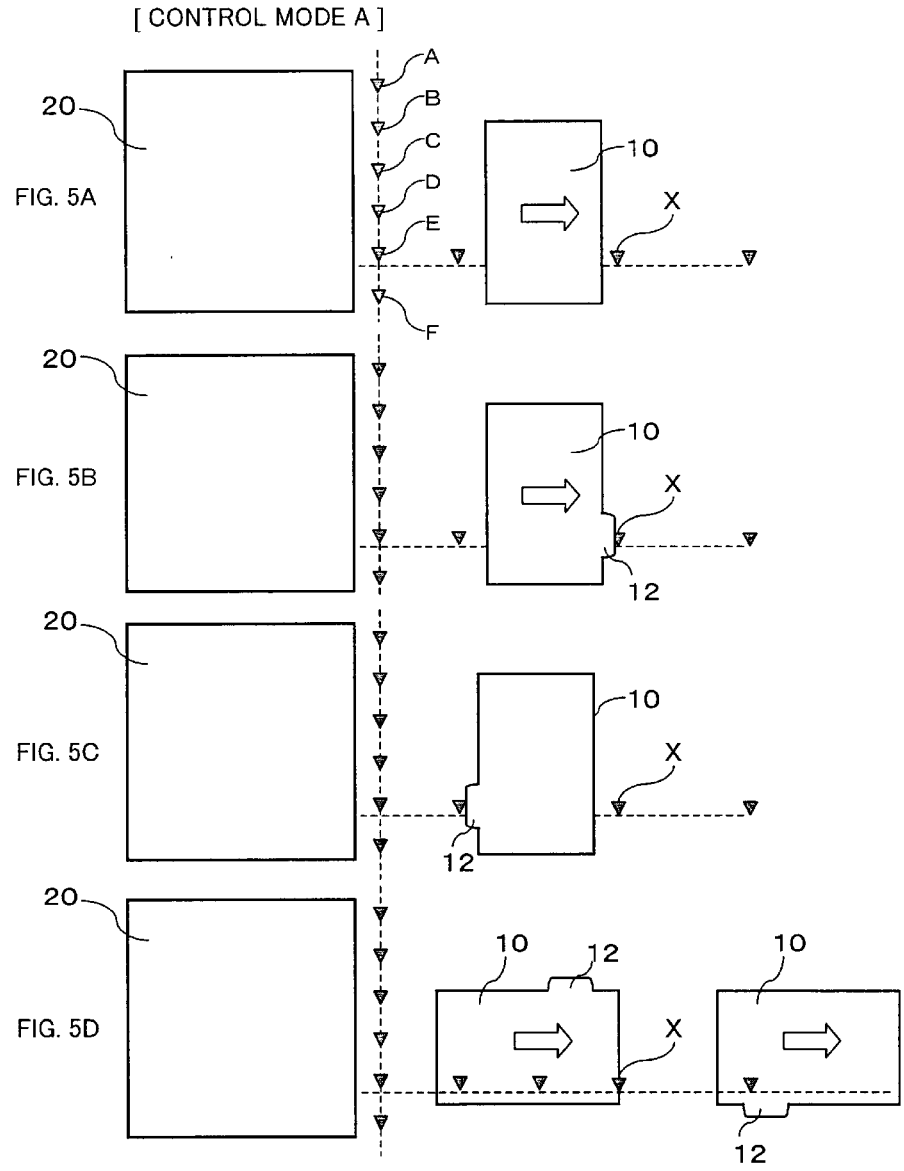
[ CONTROL MODE A ]
FIG. 5A
FIG. 5B
FIG. 5C
FIG. 5D
20
10
12
X
A
B
C
D
E
F
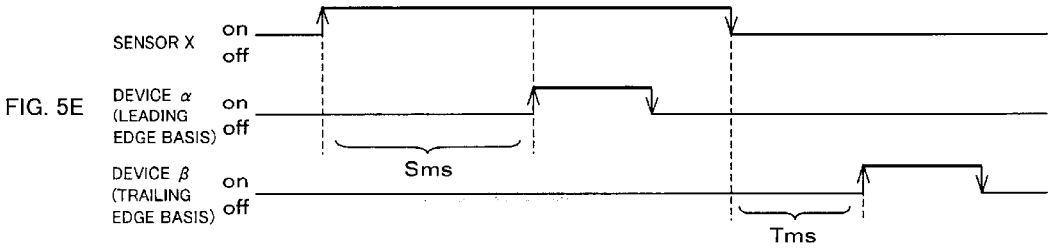
FIG. 5E
SENSOR X
on
off
DEVICE α (LEADING EDGE BASIS)
on
off
DEVICE β (TRAILING EDGE BASIS)
on
off
Sms
Tms

[ CONTROL MODE B ]

[ CONTROL MODE C ]

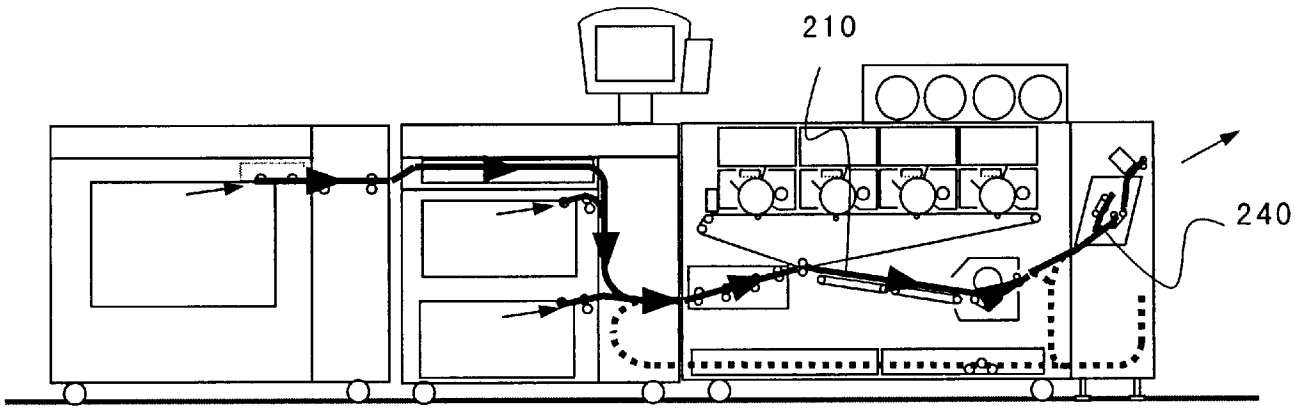

FIG. 9A

| STATE OF SHEET LOADED IN TRAY | CORRESPONDING CONTROL MODE |
|---|---|
| WHEN TAB LIES ON UPPER SIDE | "CONTROL MODE A" IS APPLIED |
| WHEN TAB LIES ON DOWN SIDE | |
| WHEN TAB LIES ON FORWARD END AND TRAVERSES TRANSPORT CONTROL SENSOR | |
| WHEN TAB LIES ON BACKWARD END AND TRAVERSES TRANSPORT CONTROL SENSOR | |
| WHEN TAB LIES ON FORWARD END AND NOT TRAVERSES TRANSPORT CONTROL SENSOR | "CONTROL MODE B" IS APPLIED |
| WHEN TAB LIES ON BACKWARD END AND NOT TRAVERSES TRANSPORT CONTROL SENSOR | "CONTROL MODE C" IS APPLIED |

FIG. 9B

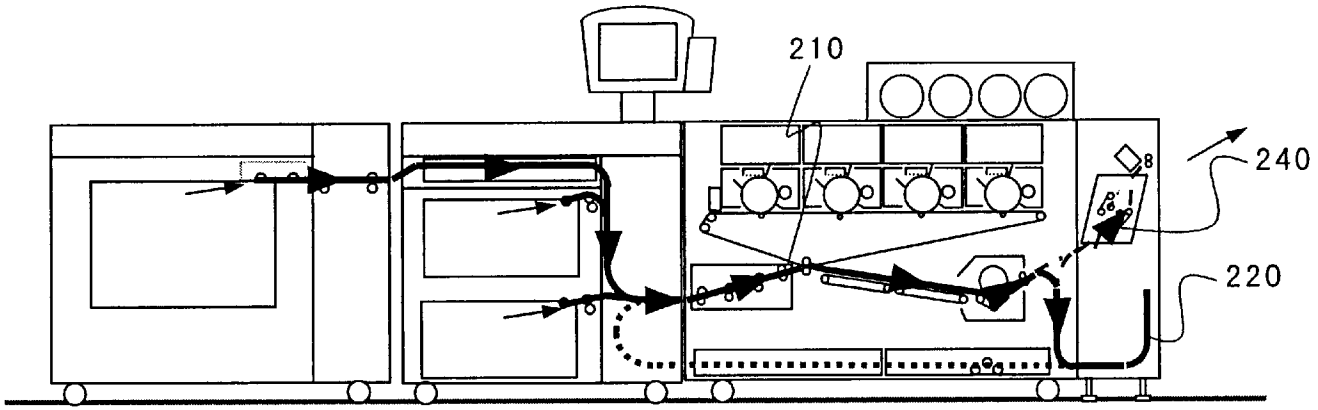

FIG. 10A

| STATE OF SHEET LOADED IN TRAY | CORRESPONDING CONTROL MODE (BEFORE REVERSE) | CORRESPONDING CONTROL MODE (AFTER REVERSE) |
|---|---|---|
| WHEN TAB LIES ON UPPER SIDE | "CONTROL MODE A" IS APPLIED | "CONTROL MODE A" IS APPLIED |
| WHEN TAB LIES ON DOWN SIDE | "CONTROL MODE B" IS APPLIED | "CONTROL MODE C" IS APPLIED |
| WHEN TAB LIES ON FORWARD END AND TRAVERSES TRANSPORT CONTROL SENSOR | "CONTROL MODE C" IS APPLIED | "CONTROL MODE B" IS APPLIED |
| WHEN TAB LIES ON BACKWARD END AND TRAVERSES TRANSPORT CONTROL SENSOR | "CONTROL MODE A" IS APPLIED | "CONTROL MODE A" IS APPLIED |
| WHEN TAB LIES ON FORWARD END AND NOT TRAVERSES TRANSPORT CONTROL SENSOR | "CONTROL MODE B" IS APPLIED | "CONTROL MODE C" IS APPLIED |
| WHEN TAB LIES ON BACKWARD END AND NOT TRAVERSES TRANSPORT CONTROL SENSOR | "CONTROL MODE C" IS APPLIED | "CONTROL MODE B" IS APPLIED |

FIG. 10B

FIG. 11C

| STATE OF SHEET LOADED IN TRAY | CORRESPONDING CONTROL MODE (PRINTING UPPER SURFACE) | CORRESPONDING CONTROL MODE (PRINTING REVERSE SURFACE) |
|---|---|---|
| WHEN TAB LIES ON UPPER SIDE<br>WHEN TAB LIES ON DOWN SIDE<br>WHEN TAB LIES ON FORWARD END AND TRAVERSES TRANSPORT CONTROL SENSOR<br>WHEN TAB LIES ON BACKWARD END AND TRAVERSES TRANSPORT CONTROL SENSOR | "CONTROL MODE A" IS APPLIED | "CONTROL MODE A" IS APPLIED |
| WHEN TAB LIES ON FORWARD END AND NOT TRAVERSES TRANSPORT CONTROL SENSOR | "CONTROL MODE B" IS APPLIED | "CONTROL MODE C" IS APPLIED |
| WHEN TAB LIES ON BACKWARD END AND NOT TRAVERSES TRANSPORT CONTROL SENSOR | "CONTROL MODE C" IS APPLIED | "CONTROL MODE B" IS APPLIED |

| | TAB LOCATION | TAB LENGTH | TAB WIDTH |
|---|---|---|---|
| FIRST SHEET | FORWARD, 200 mm | 15mm | 50mm |
| SECOND SHEET | BACKWARD, 70 mm | 20mm | 45mm |
| THIRD SHEET | LEFT, 30 mm | 20mm | 50mm |
| FOURTH SHEET | LIGHT, 80 mm | 20mm | 55mm |
| FIFTH SHEET | NO TAB | | |
| ••••••• | | | |

APPARATUS AND METHOD FOR SHEET TRANSPORT CONTROL

BACKGROUND OF THE INVENTION

1. Field of the Invention

The present invention relates to sheet transport control in a printing apparatus such as a copier or a printer, and more particularly to transportation of tab sheets.

2. Description of the Related Art

Apparatuses having a function of inserting tab sheets at predetermined positions, such as between chapters of a publication, are well known among recently introduced image-forming apparatuses such as copiers and printers. Because of the tab or tabs attached to a tab sheet, the size of a tab sheet cannot be found using the methods commonly used to find the size of typical rectangular sheets. In sheet transport control, movement of the transported sheet is detected by sensors provided at specific points along a paper path so as to enable control driving of motors and other mechanisms provided in the apparatus according to the detected movement. For sheets with a tab, the timing of detection signals from the sensors vary according to whether or not a tab portion passes through the sensors. Accordingly, when such sheets are used, there is a problem that appropriate timing control of motors and other mechanisms installed along the paper path may be impossible.

In an attempt to deal with the above problem, Japanese Patent Laid-Open Publication No. Hei 8-245047, for example, discloses an apparatus in which, by limiting sheets with tab to a specific orientation such that the tabs are located away from the paper transport direction when the tab sheets are loaded in a paper tray, in other words, by ensuring that the leading edge of all sheets in the paper transport direction are tab-free, it is possible to reliably determine the feed timing of the sheet. Alternatively, Japanese Patent Laid-Open Publication No. Hei 10-67458 discloses that, in order to circumvent feeding of tab sheets into a paper path in the main body of a copier, a specific paper tray dedicated to tab sheets and a tab printer are provided to a finisher for post-processing, such as a finisher for stapling of printed pages.

However, because with either of the above-described arts paper orientation for tab sheets loaded in the paper tray is limited, users must insert the tab sheets in the paper tray in the specified orientation, even when this operation is time-consuming or complicated. Further, the layout of a stapler and/or a puncher relative to the sheet (e.g. whether the stapler and/or the puncher are placed frontward or sideward in the paper transport direction) differs among finishers. If paper orientation must be limited when the tab sheets are loaded in the paper tray, selection of finishers will be limited to only those having an orientation corresponding to the required paper orientation.

In an apparatus disclosed in the above Japanese Patent Laid-Open Publication No. Hei 8-245047, when the tab sheet is inverted for duplex printing, the orientation of the tab is reversed from its position during upper surface printing. Because the reversed orientation therefore makes proper timing of transport control impossible, the apparatus has a problem in that tab sheets cannot be duplex printed.

Because the tab printing mechanism provided on the finisher does not support duplex printing, the apparatus disclosed in Japanese Patent Laid-Open Publication No. Hei 10-67458 is incapable of performing duplex printing on tabbed sheets. Because a finisher modified to support duplex printing becomes very large, such modification is not practical. Further, because the described printing mechanism which may be installed on the finisher is capable of producing printed output only on small regions such as tabs, it is impossible to produce printed output on the main body of the tab sheets.

SUMMARY OF THE INVENTION

The present invention, which was conceived in view of the aforesaid current problems, aims to provide a sheet transport apparatus in which tabbed sheets can be loaded in a paper tray in an arbitrary orientation and wherein appropriate timing control of such tabbed sheets is possible, even when duplex printing is executed.

An apparatus for sheet transport control according to the present invention, which controls sheet transport on a paper path, comprises a tab information detector for obtaining information about whether or not a tab lies on at least either one of the leading edge and the trailing edge of the sheet in a sheet transport direction and about a tab location of the detected tab on the leading edge and/or the trailing edge in a direction perpendicular to the paper transport direction when the tab is detected, a sheet traverse detector which is installed on a checkpoint established on the paper path for detecting the timing of paper traverse (the state of movement or feed of paper as it travels through the device) that at least either one of the leading edge and the trailing edge of transported sheet passes through the checkpoint, and a controller for determining operation timing of control targets according to the traverse timing detected by the sheet traverse detector. The controller determines whether or not a tab has passed through the checkpoint based on the presence or absence of the tab and relationship between the tab position obtained at the tab information detector and the position of the checkpoint in the direction perpendicular to the paper transport direction, and then adjusts the operation timing of the control targets according to whether or not the tab passes through the checkpoint.

In one aspect of the present invention, a tab information detector comprising a plurality of paper sensors, each of which is provided on either one of a plurality of positions established upstream from the checkpoint on the paper path in the direction perpendicular to the sheet transport direction, for detecting whether or not a sheet is present at the position of the sensor, detects whether or not a tab is present and the tab location in the direction perpendicular to the paper transport direction based on detection of output signals of the paper sensors.

In another aspect of the present invention, the apparatus for sheet transport control comprises a tab detector which detects whether or not a tab is present on the sheet and, when a tab is detected, the tab location, and a controller having a plurality of control modes for sheet transport in accordance with the presence or absence of the tab and the tab location on the sheet, the controller controlling sheet transport according to a control mode for sheet transport corresponding to the presence or absence of the tab and the location of the tab detected by the tab detector.

In still another aspect of the present invention, the apparatus for sheet transport control including an input interface of tab orientation which accepts input regarding which side of the sheet has a tab and a controller having a plurality of control modes for sheet transport in accordance with the side of the sheet having the tab, the controller performs sheet transport in the control mode for sheet transport corresponding to the input accepted in the tab orientation input interface.

In still another aspect of the present invention, the apparatus for sheet transport control, which controls transport of a sheet with tab, comprises a tab location detector for obtaining information about a tab location in the direction perpendicular to the sheet transport direction, a sheet traverse detector provided on a paper path for detecting at least either one of the leading edge and the trailing edge of the transported sheet so as to find traverse of the transported sheet, and a setting apparatus for establishing the transport control timing necessary for transporting the sheet based on relationship between the tab location obtained by the tab location detector and the position of the sheet traverse detector in the direction perpendicular to the sheet transport direction.

BRIEF DESCRIPTION OF THE DRAWINGS

FIGS. 5A, 5B, 5C, 5D, and 5E are drawings for explaining a control mode A of a timing control according to the embodiment;

FIGS. 9A and 9B are drawings showing selection rules for a timing control mode in a simplex-print mode;

FIGS. 10A and 10B are drawings showing selection rules for a timing control mode in a simplex-print inverting output mode;

FIGS. 11A, 11B, and 11C are drawings showing selection rules for a timing control mode in a duplex-print mode.

DESCRIPTION OF THE PREFERRED EMBODIMENT

In accordance with drawings, an embodiment of the present invention is described below.

Before proceeding to describe the structure of the apparatus and control details according to the embodiment, terms used to describe tabs and aspects related to tabs will be explained referring to FIGS. 1A, 1B, 1C, 1D, and 1E.

Figure 1A:
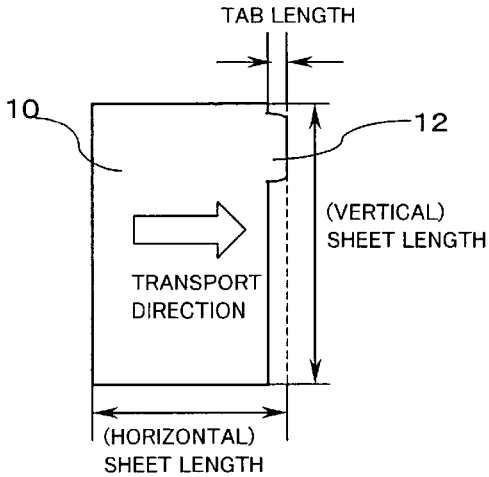
FIGS. 1A, 1B, 1C, 1D, and 1E are drawings for explaining terms defining aspects related to a tab.
Figure 1B:
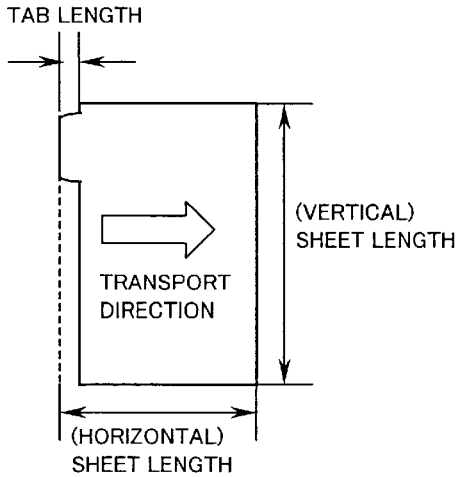
Figure 1C:
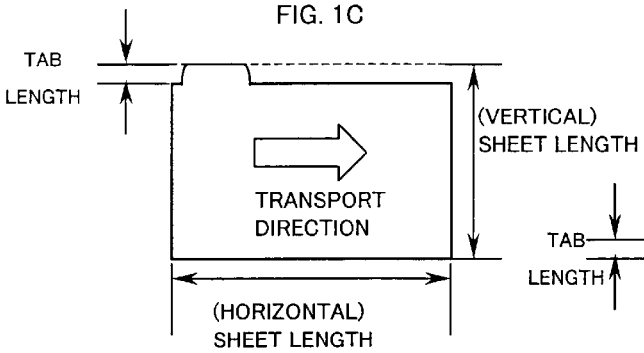
Figure 1D:
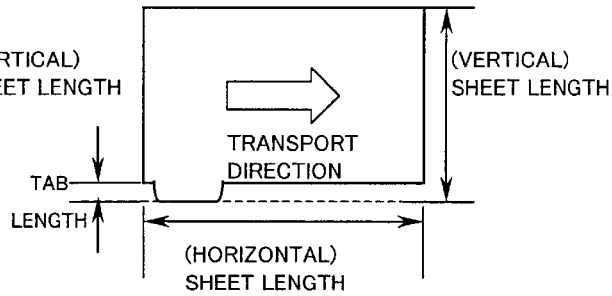

FIG. 1A shows a state in which a tab 12 of a sheet 10 with tab protrudes from the main body of the sheet toward the front along the transport direction. FIG. 1B shows a state in which the tab 12 protrudes toward the rear along the transport direction. FIG. 1C shows a state in which the tab 12 protrudes toward the left when viewed along the transport direction. FIG. 1D shows a state in which the tab 12 protrudes toward the right when viewed along the transport direction.

As shown in the above drawings, "tab length" is the amount (length) the tab 12 protrudes or extends beyond the edge of the main body of the sheet. The length of sheet in the transport direction is referred to as "horizontal" sheet length, which includes the tab length when the tab 12 is protruded toward either the front or the rear in the transport direction as shown in FIGS. 1A and 1B. On the other hand, the length of sheet in a direction perpendicular to the transport direction is referred to as "vertical" sheet length, which includes the tab length when the tab 12 protrudes toward the direction perpendicular to the transport direction as shown in FIGS. 1C and 1D.

Figure 1E:
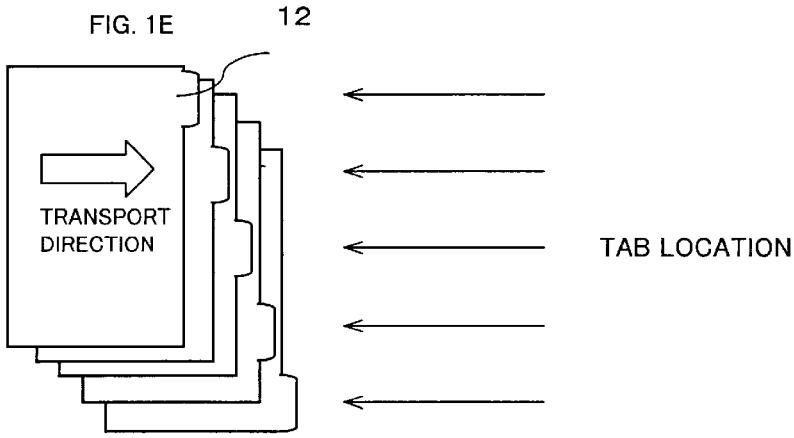

Further, the location (height) of the tab in the direction perpendicular to the transport direction (i.e. "vertical" direction) is referred to as "tab location", as shown FIG. 1E.

Referring now to FIGS. 2A, 2B, 2C, 2D, 3A, 3B, and 3C, tab detection processing according to the present embodiment will be described below using the terms defined above.

Figure 2A:
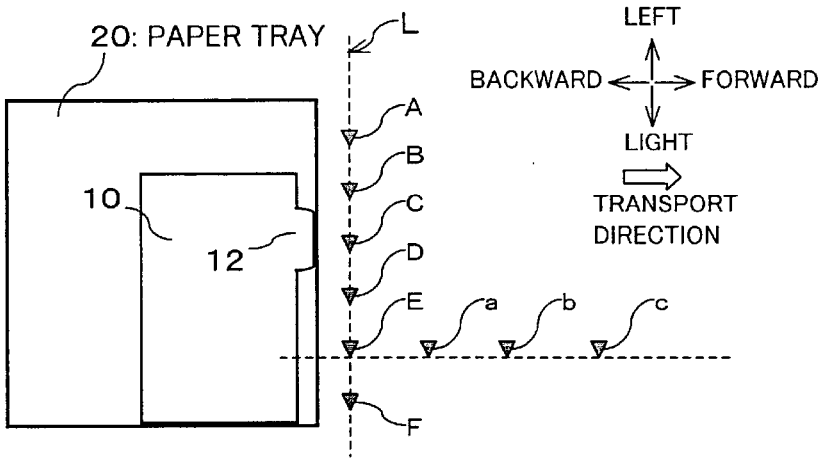
FIGS. 2A, 2B, 2C, and 2D are drawings for explaining tab detection processing according to an embodiment of the present invention.

FIGS. 2A, 2B, 2C, and 2D show the sheet 10 with tab loaded in the orientation that the tab 12 is placed at the leading end of the sheet 10 in the transport direction in a paper tray 20 which serves as a source of paper feed. In this embodiment, paper sensors A, B, C, D, E, and F installed on the output side of the paper tray 20 are aligned on a line L perpendicular to the transport direction as shown in FIG. 2A. Accordingly, the sensors A–F have the same distance from the edge of the paper tray 20 in the transport direction. The sensors A–F are spaced uniformly along line L so as to cover most of the range of a paper output slot. Each of the sensors A–F for detecting whether or not the sheet present immediately below the sensor position may have the structure of, for example, a set of a laser diode and a photosensor, in which the laser diode is provided above the paper path and emits light vertically downward and the photosensor is provided below the paper path and receives the light emitted from the laser diode. In this structure, each of the sensors A–F outputs either one of two signals at different levels (one level may be established as ON and the other level may be established as OFF) depending on whether or not the sheet lies between the laser diode and the photosensor. Although sensors of transmitted light detection type are used as the paper sensors A, B, C, D, E, and F in the above description, it is to be understood that these are described as one example of possible configurations. Also it is to be understood that optical sensors of reflected light detection type or sensors for mechanically detecting the presence or absence of the sheet may be used as the paper sensors A, B, C, D, E, and F without departing from the spirit of the invention.

In the paper path, transport control sensors a, b, c, . . . are provided at checkpoints established downstream from the paper sensors A–F. The checkpoints are placed on their respective positions which vary in distances from the edge of the paper tray 20 in the transport direction but aligned on the same line parallel to the transport direction (the line is taken on a position passing through the paper sensor E in this example). In an image-forming apparatus, the transport control sensors a, b, c, . . . detect paper-traverse timing that the leading/trailing edge (i.e. the forward/backward end) of the sheet in the transport direction passes through the checkpoints so as to determine operation timings (for example, the timing of activating or terminating operation) of various types of devices/mechanisms equipped on the paper path from the detected paper-traverse timing. That is, each operation of the devices/mechanisms is controlled based on detection signal(s) obtained from one or more predetermined transport control sensors installed forward and/or backward of the devices/mechanisms on the paper path. As the devices installed on the paper path, various types of devices/mechanisms such as a motor for driving a transfer belt constituting the paper path, an exposure mechanism, a transfer mechanism, and a fixing mechanism may be counted. In the exposure mechanism, for example, timing of operations such as activation/termination timing of a motor to rotate a photosensitive drum and initiation timing for exposing the photosensitive drum to light are determined according to the paper-traverse timing at the checkpoints established forward and backward of the photosensitive drum. As the transport control sensors a, b, c, . . . , hardware similar to the paper sensors A–F may be utilized.

Figure 2B:
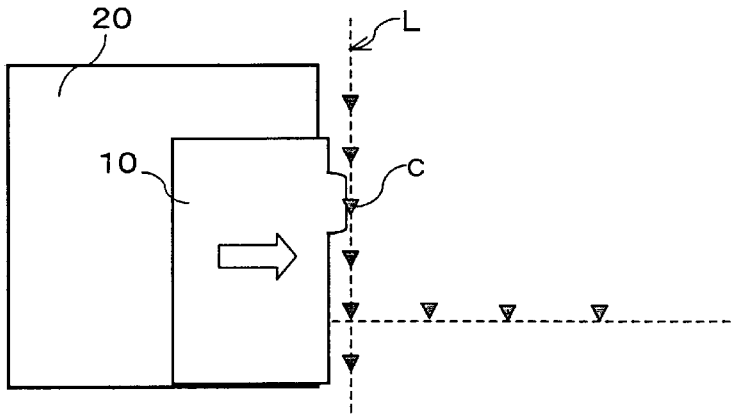
Figure 2C:
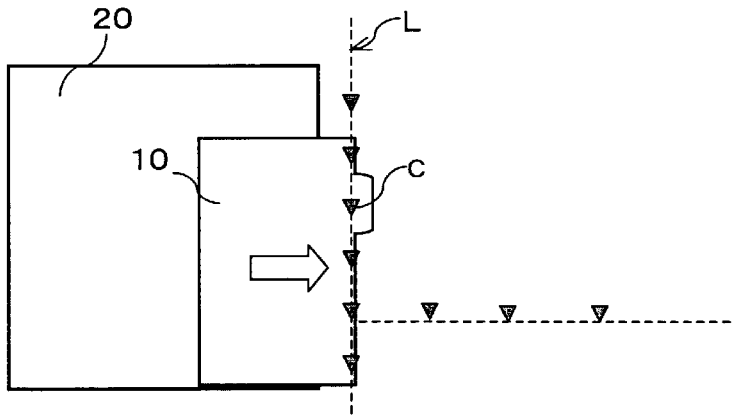
Figure 2D:
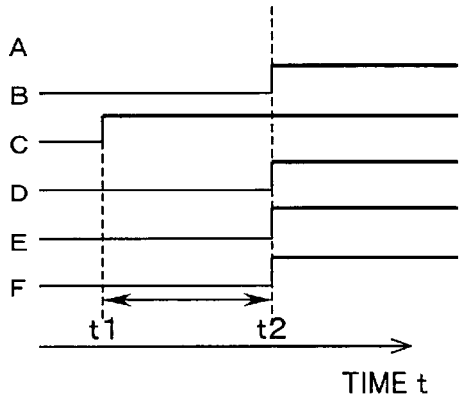

A detection scheme for detecting the tab 12 through the use of the paper sensors A–F will be described below referring to FIGS. 2B, 2C, and 2D. FIG. 2D shows a timing chart of output signals from the paper sensors A–F. With regard to the process of feeding the sheet 10 with tab from the paper tray 20, first, all the paper sensors A–F output signals at OFF level because they do not detect the existence of the sheet 10 with tab at the first stage. As shown in FIG. 2B, when time t is t1 and the leading end of the tab 12 reaches to the line L where the paper sensors A–F are aligned, the paper sensor C begins to output a signal at ON level after detecting the sheet 10 with tab and the remaining paper sensors maintain their output at OFF level. This state tells that the tab 12 lies on the leading edge of the sheet 10 with tab in the transport direction (hereafter simply referred to as the leading edge) at the location equivalent to the position of the paper sensor C. When time t reaches t2 and the main body of the sheet 10 with tab reaches the line L as shown FIG. 2C, all the outputs from the paper sensors B, C, D, E, and F become ON level. The time difference between time t1 and time t2 corresponds to the tab length of the tab 12. Because the paper sensor A is located beyond the area corresponding to the vertical length of the sheet 10 with tab, the output from the paper sensor A remains at OFF level all this while. Accordingly, it is acceptable to ignore output of any paper sensor which always outputs OFF level during the detection process for determining the presence and size of a tab.

Figure 3A:
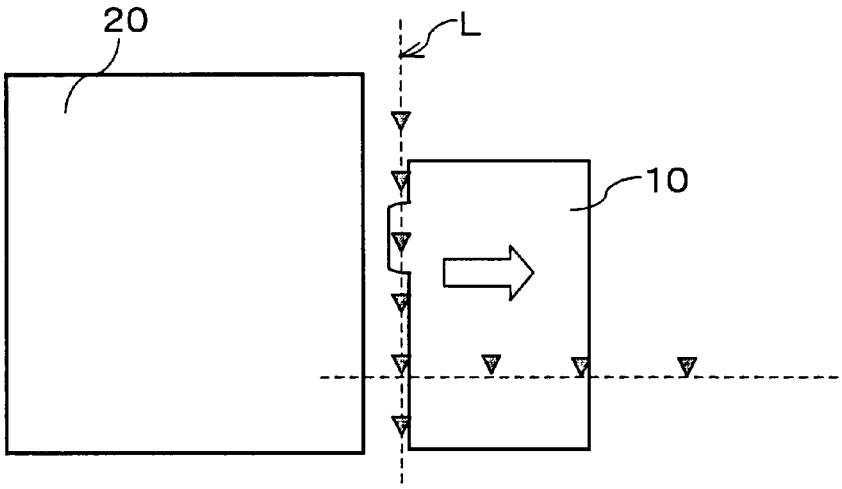
FIGS. 3A, 3B, and 3C are drawings for explaining tab detection processing according to an embodiment of the present invention.
Figure 3B:
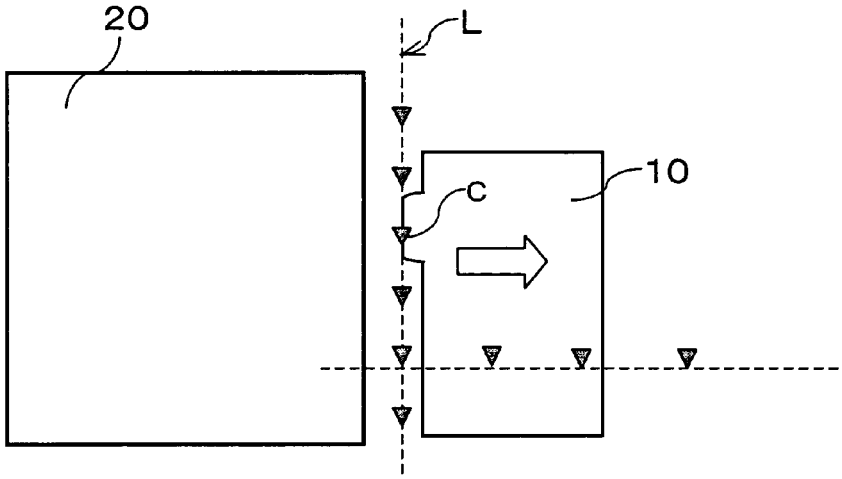
Figure 3C:
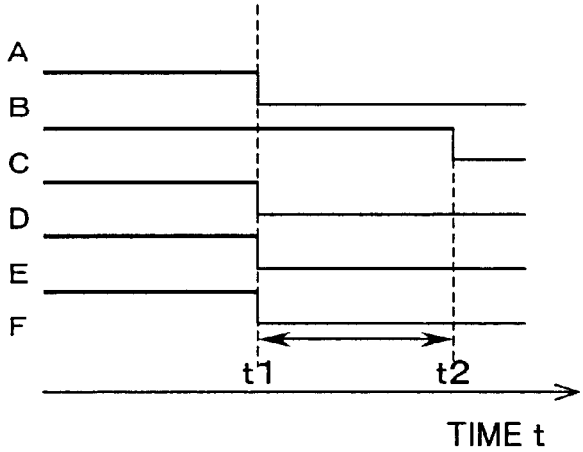

FIGS. 3A, 3B, and 3C show a tabbed sheet 10 loaded in an orientation such that the tab 12 is placed at the trailing end of the sheet 10 in the transport direction in the paper tray 20. Because the tab 12 does not lie on the leading edge of the sheet 10 with tab in this example, the timings of the origination of output signals from the paper sensors B to F are coincident with each other. Here it should be noted that the paper sensor A, which maintains the output at OFF level even though all the output of the other paper sensors B to F turn ON level, is determined to be out of the area corresponding to the sheet 10 with tab and ignored in the detection process for the tab. When time t is elapsed to t1, only the tab 12 lies on the line L and the main body of the sheet 10 with tab moves forward beyond the line L as shown in FIG. 3A. Accordingly, at time t1, the outputs from the paper sensors B, D, E, and F fall and only the output from the paper sensor C remains at ON level as shown in FIG. 3C. This state reveals that the tab 12 lies on the trailing edge of the sheet 10 with tab in the transport direction (hereafter simply referred to as the trailing edge) at a location corresponding to the position of the paper sensor C. When time t reaches t2, the output from the paper sensor C falls because the trailing edge of the tab 12 passes through the line L. The tab length is obtained from a time difference between time t1 and time t2.

When a plain sheet without a tab is used, or when a tabbed sheet is loaded in the orientation that the tab is placed on either side, parallel to the transport direction, of the sheet in the paper tray 20, all the outputs from the sensors placed within the area corresponding to the sheet among the paper sensors A–F rise and fall simultaneously because the tab lies neither on the leading edge nor on the trailing edge of the sheet.

According to the above-described mechanisms, by using a combination of the outputs from the paper sensors A–F provided on the Line L, it is possible to determine whether or not a tab is located on either the leading edge or the trailing edge of the sheet, and if a tab 12 is detected, find the approximate tab location of the detected tab, i.e. to determine which of paper sensors A, B, C, D, E, or F is at a location corresponding to that of the tab 12.

When a width of the tab (a size of the tab in a direction perpendicular to the tab length) is larger than the spacing between adjacent paper sensors, the outputs from the two or more adjacent paper sensors change to another level at the same time, not coincident with the other paper sensors.

Although in this example six sensors are employed as the paper sensors for tab detection, the number of paper sensors is not limited to six and may be determined according to the most likely or most common tab widths.

In contrast to the case of the paper sensors A–F for tab detection, to each of the checkpoints is provided one transport control sensor a, b, c, . . . . Therefore, each timing of the rising or falling of output signal from the transport control sensors a, b, c, . . . , differs according to whether or not the tab 12 moves along a line where the transport control sensors a, b, c, . . . are aligned. Because prior art apparatuses do not take such timing differences into consideration, they are incapable of performing appropriate timing control on each of the devices on the paper path. On the other hand, according to the present invention, by determining whether or not the tab 12 moves relative to a line along which the transport control sensors a, b, c, . . . are aligned based on relationship between the position of the transport control sensors a, b, c, . . . in a direction perpendicular to the transport direction and the tab location detected by the paper sensors A–F so as to adjust each operation timing of the devices according to the determination result, it becomes possible to implement sufficiently accurate timing control.

Figure 4:
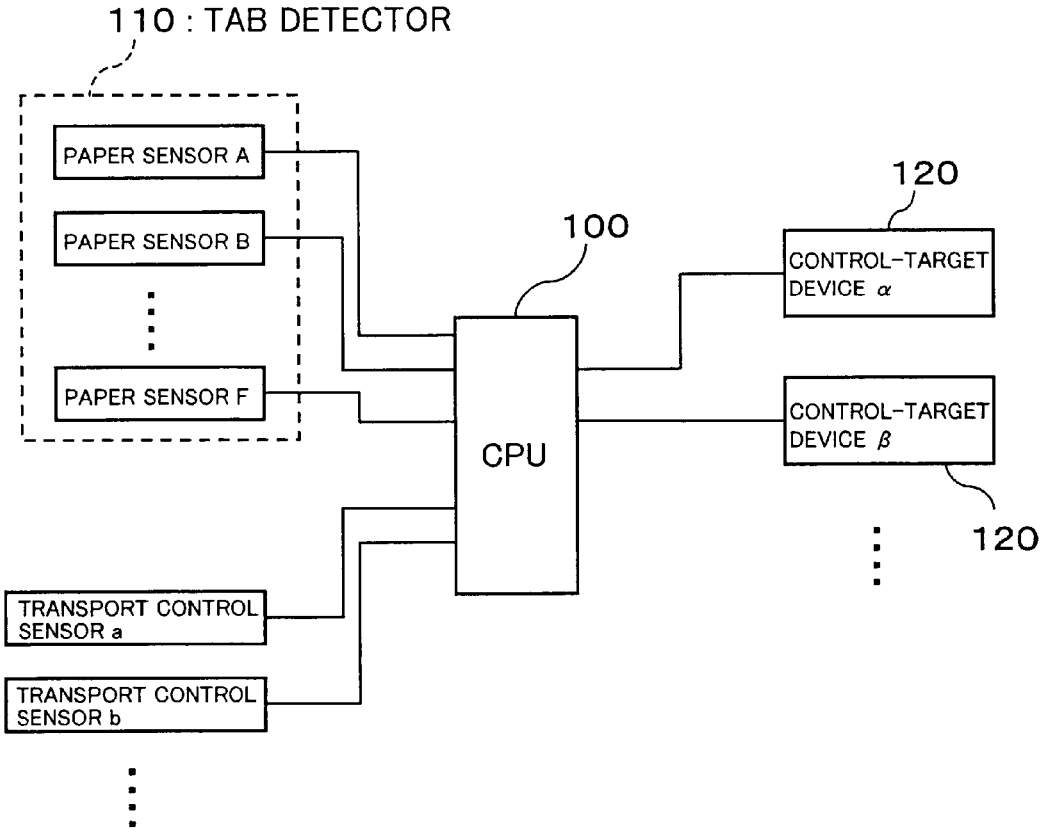
FIG. 4 is a schematic diagram of a hardware configuration in a sheet transport control mechanism.

FIG. 4 shows an example of a hardware configuration for controlling sheet transport in the image-forming device according to the present embodiment. The above-described paper sensors A–F constitute a tab detector 110 having a function of performing a tab detection process in which the outputs from the paper sensors A–F are input to a CPU 100. The outputs from the transport control sensors a, b, . . . are also input to CPU 100. Further, control-target devices 120 ($\alpha$, $\beta$, . . . ) such as motors equipped at positions along the paper path and the exposure mechanism connected to CPU 100 receives signals for specifying each operation timing of the various devices from CPU 100.

As specific control of the control-target devices 120, the following examples are counted: timing control for driving motors to rotate transport rollers provided along the paper path, timing control for writing a latent image on a photosensitive material in an exposure apparatus, timing control for driving one or more solenoids to engage/disengage a transfer belt to/from a transfer roller, timing control for driving a motor to actuate one or more gate members for switching the paper path, timing control for driving one or more solenoids to engage/disengage a pair of inverting rollers provided on a switch back path with each other, and shift control of operation timing of a decurler for returning the paper curled by image forming to its original state. Although the above-described control is executed associated with mechanical actions, control executed without mechanical action, such as control of paper jam detection, are also included in the control of the control-target devices 120.

The CPU 100 executes predetermined procedures of control processing according to a control program or parameter values stored in a ROM or a non-volatile memory (not illustrated in FIG. 4). In this control processing, signals for operation timing are provided to the control-target devices 120 based on the output signals from the paper sensors A–F and the transport control sensors a, b, etc. According to the present example, in order to control the operation timing, one or more of three different control modes are selectively used according to the situation. The control modes are described with reference to FIGS. 5A, 5B, 5C, 5D, 5E, 6A, 6B, 7A, and 7B.

FIGS. 5A, 5B, 5C, 5D, and 5E are drawings for explaining a control mode A as a first mode. The control mode A is adopted when the sheet 10 does not have a tab (see FIG. 5A); when the tab 12 is located on the leading edge or the trailing edge of the sheet in an area which moves on the line where the transport control sensors a, b, c, . . . are present (see FIG. 5B and C); or when the tab 12 is located on either side, parallel to the transport direction, of the sheet (see FIG. 5D).

In examples (including examples of FIGS. 6A, 6B, 7A, and 7B) where this is a device a of which operation timing of activation is established so as to be delayed for a predetermined time period s (milliseconds) from the time when the output signal from a transport control sensor X rises up (i.e. a paper-traverse timing that the leading edge of the sheet passes through the checkpoint) and a device β of which operation timing of activation is established so as to be delayed for a predetermined time period t (milliseconds) from the time when the output signal from the transport control sensor X falls (i.e. a paper-traverse timing that the trailing edge of the sheet passes through the checkpoint), delays in the time periods s and t of operation timing for the devices α and β based on the timing of switching between ON and OFF of the output from the transport control sensor X may be determined assuming a case where sheets without tabs are transported. Accordingly, when a tabless sheet is loaded, the devices α and β are activated according to their respective timing specifications (FIG. 5A). Timing charts for the output signal from the transport control sensor X, and operation timing signals each provided from CPU 100 to the device α or the device β in this example are shown in FIG. 5E.

When a tab 12 is located on neither the leading edge nor the trailing edge of the sheet in the transport direction as shown in FIG. 5D, the control mode A is adopted, just as is the case with the sheet without tab, because the outputs from the paper sensors A–F show a pattern identical to the pattern obtained when the sheet without tab is used.

Even in instances where the tab 12 is located on either the leading edge or the trailing edge of the sheet as shown in FIGS. 5B and 5C, when the tab 12 lies in an area which passes through the transport control sensor X, each operation timing is controlled just as is the case where the sheet without tab is loaded in this embodiment because operation timing of the devices α and β is determined on the basis of the timing that the leading edge or the trailing edge of the tab passes through the checkpoints. Motors and gates for sheet transport are controlled according to this criteria.

Figure 6A:
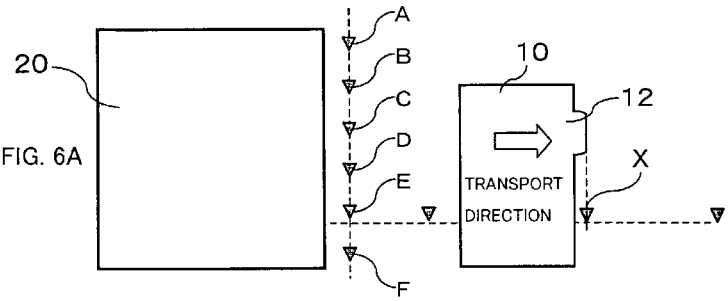
FIGS. 6A and 6B are drawings for explaining a control mode B of a timing control according to the embodiment.
Figure 6B:
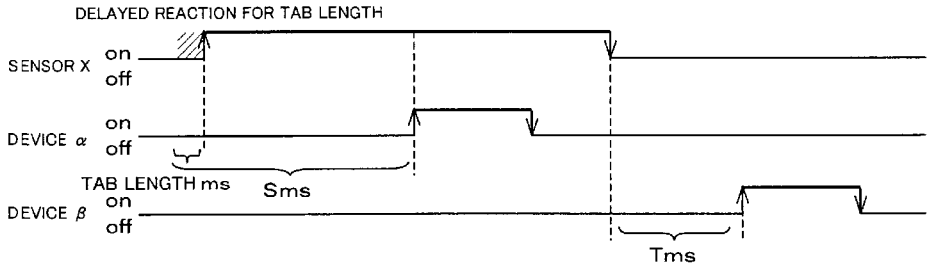

FIGS. 6A and 6B are drawings for explaining a control mode B as a second mode. As shown in FIG. 6A, the control mode B is adopted when a tab 12 is located on the leading edge of the sheet 10 in an area which does not pass through the transport control sensor X. In such an example, the timing of the rising of output from the transport control sensor X is delayed for a time period corresponding to the tab length relative to the time, used as the timing control criteria in this case, when the leading edge of the sheet (i.e. the leading edge of the tab 12) actually passed through a position corresponding to the position of the transport control sensor X. Accordingly, it is necessary in this example to advance operation timing of activating the device α determined based on the timing of the rising (the leading edge of the sheet) by a length of time corresponding to the tab length from the time determined by adding the predetermined time period s to the time of the rising. This advancement makes it possible to obtain appropriate operation timing relative to the leading edge of the sheet. On the other hand, the device β of which operation timing is determined based on the timing of the falling of output from the transport control sensor X may be handled in the same fashion as the tabless sheet.

Figure 7A:
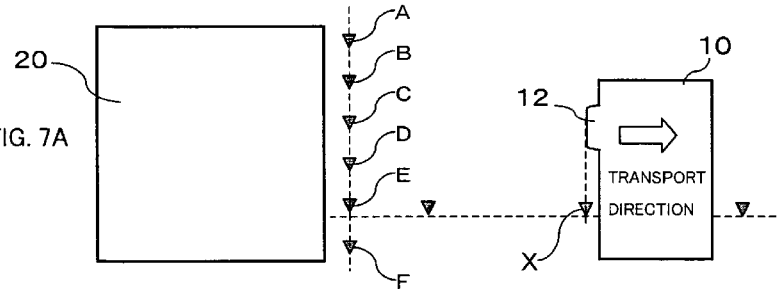
FIGS. 7A and 7B are drawings for explaining a control mode C of a timing control according to the embodiment.
Figure 7B:
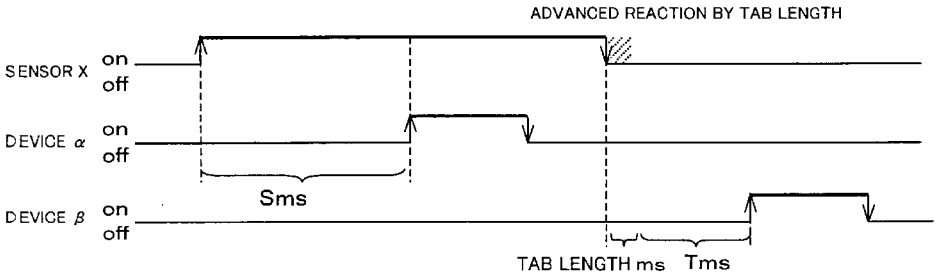

FIGS. 7A and 7B are drawings for explaining a control mode C as a third mode. As shown in FIG. 7A, the control mode C is adopted when the tab 12 is located on the trailing edge of the sheet 10 in an area which does not pass through the transport control sensor X. In this example, the timing of the falling of output from the transport control sensor X advances by a time period corresponding to the tab length from the time, used as the timing control criteria in this case, when the trailing edge of the sheet (i.e. the leading edge of the tab 12) actually passes through a position corresponding to the position of the transport control sensor X. Accordingly, in this example, it is necessary to delay operation timing of activation of the device β based on the timing of the falling (the trailing edge of the sheet) for period of time corresponding to the tab length from the time determined by adding the predetermined time period t to the time of the falling. Delaying the operation in such a manner makes it possible to achieve appropriate operation timing relative to the tailing edge of the sheet. On the other hand, the device α of which operation timing is determined based on the timing of the rising of output from the transport control sensor X may be operated in the same fashion as for a sheet without a tab.

In the above, examples wherein each operation timing of the control-target devices is determined based on the timing at which the leading or trailing edge of the tab 12 passes through the checkpoints have been described. However, there are instances where operation timing is determined based on a timing that the leading or trailing edge of the main body of the sheet (a portion except the tab) passes through the checkpoints. In such a case, when the tab 12 does not pass through the transport control sensor X (when the tab 12 is located in a relationship as shown in FIGS. 6A and 7A), the control mode A described in the example of FIGS. 5A–5E is adopted. Further, in such a case, when the tab 12 is located on the leading edge of the sheet in an area which passes through the transport control sensor X, each operation timing of the devices which is determined based on the timing of the rising of output from the transport control sensor X must be delayed for the length of time corresponding to the tab length from the operation timing used for the sheet without tab. On the other hand, when the tab 12 is located on the trailing edge of the sheet in the area which passes through the transport control sensor X, each operation timing of the devices which is determined based on the timing of the falling of output from the transport control sensor X must be advanced by the length of time corresponding to the tab length from the operation timing used for the sheet without tab.

Although examples for determining operation timing of activating control targets according to the output signal from the transport control sensor have been described with reference to FIGS. 5A–7B, operation timing for various actions other than the timing of activation may be specified in a like manner using the output from the transport control sensor.

As an example other than the timing of activation, operation for detecting paper jam based on the timing that the sheet 10 passes through the transport control sensor X will next be described.

In the image-forming apparatus, a time period Tdet from the time when the leading edge of the sheet is detected by the transport control sensor X to the time when the trailing edge of the sheet is detected by the same is measured so as to compare the obtained time period Tdet with a threshold value Tref for paper jam detection predetermined for detecting paper jam. When Tdet is larger than Tref, it is judged that a paper jam has occurred, triggering initiation of processing necessary for termination of sheet transport.

In this example, when it is determined from the output of the paper sensors A–F that the tab 12 has not passed through the position of the transport control sensor X, a timing value for paper jam detection for standard sheets (i.e. non-tab sheets) is used as Tref. On the other hand, when it is determined from the outputs from the paper sensors A–F that the tab passes through the position of the transport control sensor X as shown in FIGS. 5B and 5C, a value obtained by adding a value corresponding to the tab length to the timing value for paper jam detection for the standard sheets is used as a timing value Tref for paper jam detection.

In another example for jam detection, it is judged that a paper jam has occurred when the sheet does not reach the transport control sensor X until the time of the timing value Tref for paper jam detection will be elapsed since either one of the paper sensors A–F detects the leading edge of the sheet. In such an instance, when it is determined from the output from the paper sensors A–F that a tab is located on the leading edge of the sheet in an area which passes through the position of the transport control sensor X as shown in FIG. 5B, the timing value Tref for paper jam detection used for the standard sheets is also used as Tref of this example. On the other hand, when it is determined that a tab is located on the leading edge of the sheet in an area which does not pass through the position of the transport control sensor X as shown in FIG. 6A, a value obtained by adding the length of time corresponding to the tab length to the timing value of paper jam detection for the standard sheets is used as the timing value Tref for paper jam detection of this example. When the tab is determined as being located on the trailing edge of the sheet from the output from the paper sensors A–F or from user input as shown in FIG. 7A, the timing value of paper jam detection for the standard sheets is also used as Tref of this case.

Up to this point, basic concepts regarding the control modes related to operation timing for the apparatus according to the present embodiment have been described. Because there is a possibility that a sheet may be inverted so that the upper surface faces down in the actual image-forming processing for duplex printing or inverting output, the orientation of the tab may change from a state of facing forward relative to the transport direction to a state of facing backward relative to the transport direction during the course from paper feeding to output of printed results. Accordingly, in the present embodiment, by switching the control mode among the above-described control modes A, B and C corresponding to inverting operation of the sheet on the paper path, it becomes possible to execute appropriate timing control under every circumstance. This switching control is described below with reference to FIGS. 8, 9A, 9B, 10A, 10B, 11A, 11B, and 11C.

Figure 8:
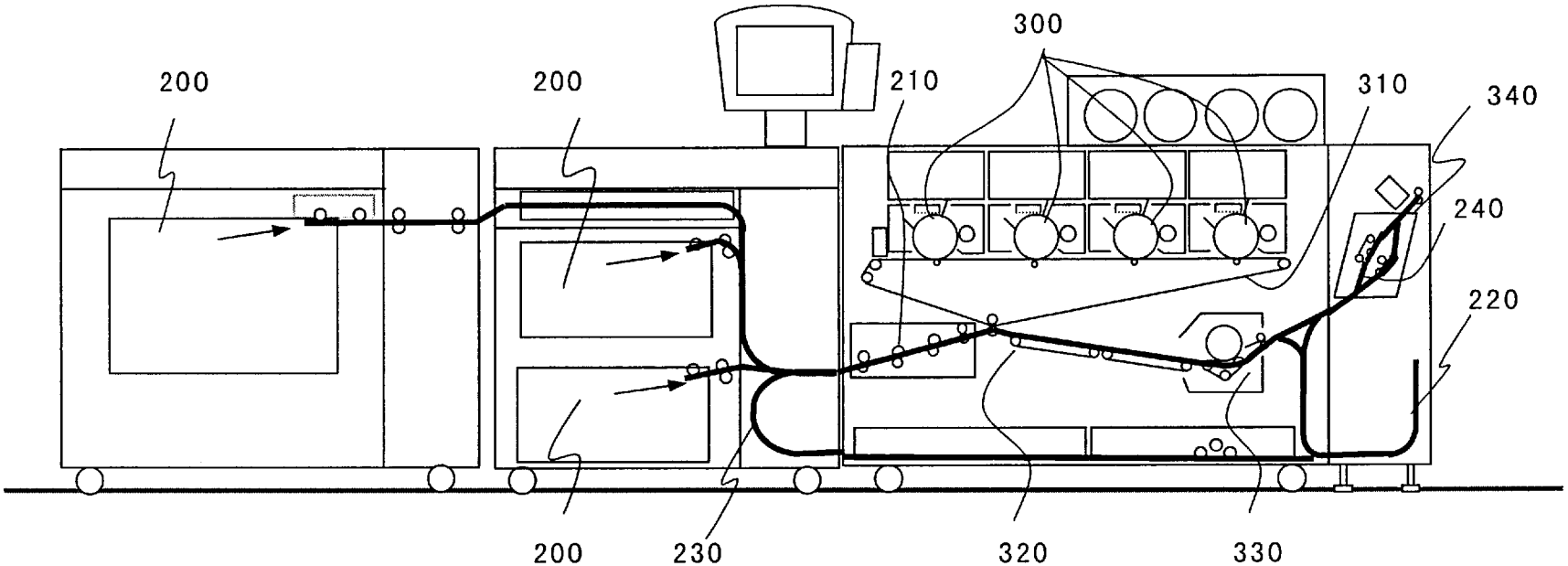
FIG. 8 is a drawing showing a paper path in an image-forming apparatus.

FIG. 8 is a schematic drawing depicting the structure of an image-forming apparatus described in the following. The image-forming apparatus comprises three paper trays 200. A set of paper sensors A, B, C, D, E, and F for tab detection installed in each proximity to paper output slots of the paper trays 200 detects a tab on a sheet fed from each of the paper trays 200 to a paper path. The sheet fed from either one of the paper trays 200 is processed along paper paths 210, 220, and 230 according to print modes such as simplex-print mode, duplex-print mode, or the like. The paper path 210 is a main path on which images are formed and then fixed on the upper surface of the sheet. In this example, toner images are transferred onto an intermediate transfer belt 310 from photosensitive drums 300, each of which corresponds to either one of cyan, magenta, yellow, and blue. The transferred toner images are further transferred on the upper surface of the sheet in a transfer section 320 on the main path 210. The toner images transferred on the sheet are fixed at a fixing section 330 provided downstream from the transfer section 320. In a simplex print mode, the sheet is further forwarded after fixing on the main path 210 just as it is, and ejected from an output slot 340 into an output tray (not illustrated). In a simplex inverting output mode, on the other hand, the sheet is transported from the main path 210 to a switch back path 220 wherein the sheet is inverted so the upper surface faces down after fixing, and then the inverted sheet is transported on an output path 240 and then ejected from the output slot 340. In a duplex print mode, the sheet is inverted so as that the then upper surface will face down on the switch back path 220 after fixing, and then the inverted sheet is fed back through a circulation path 230 to the main path 210 where image transfer and fixing are performed on the reverse surface of the sheet, which is then transported on the output path 240 and then ejected from the output slot 340.

Timing control of the image-forming apparatus in the simplex print mode is shown in FIGS. 9A and 9B. Because, in this mode, the sheet is transported only on the main path 210 without being inverted as shown by the solid arrows in FIG. 9A, the control modes are selected as follows as shown in FIG. 9B. When the tab of the sheet loaded on the paper tray is located on either side, parallel to the transport direction, of the sheet, or when the tab of the sheet loaded on the paper tray is located on either the leading end or the trailing end of the sheet in the transport direction in an area which passes through the transport control sensor, the above-described control mode A is adopted. When the tab is located on the leading end in the transport direction in an area which does not pass through the transport control sensor, the above-described control mode B is adopted. Further, when the tab is located on the trailing end in the transport direction in an area which does not pass through the transport control sensor, the above-described control mode C is adopted.

Referring to FIGS. 10A and 10B used for explaining timing control in the simplex-print inverting output mode, FIG. 10A shows the path along which the sheet is transported and FIG. 10B shows selection rules for control modes. Because in the simplex-print inverting output mode the sheet is not inverted along the course from the main path 210 until the switch back path 210 indicated by the solid arrows in FIG. 10A, either one of the control modes A, B, and C may be adopted according to the same selection rules as described above. In contrast to this, because the orientation of the sheet is reversed relative to its forward and backward directions on the course from the switch back path 220 passing through the output path 240 to be ejected, the tab originally located on either the leading end or the trailing end of the sheet moves to the opposite end from the original location after the reverse. Accordingly, when the tab is located on either the leading end or the trailing end in the area which does not pass through the transport control sensor, the control mode B used before the reverse is switched to the control mode C after reversing and the control mode C used before the reverse is switched to the control mode B after reversing.

Figure 11A:
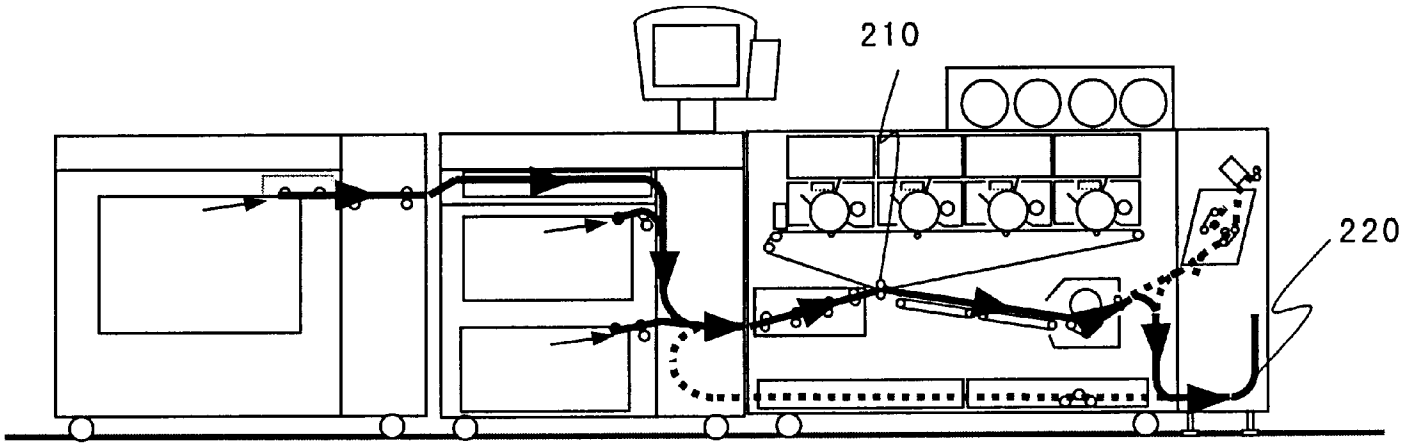
Figure 11B:
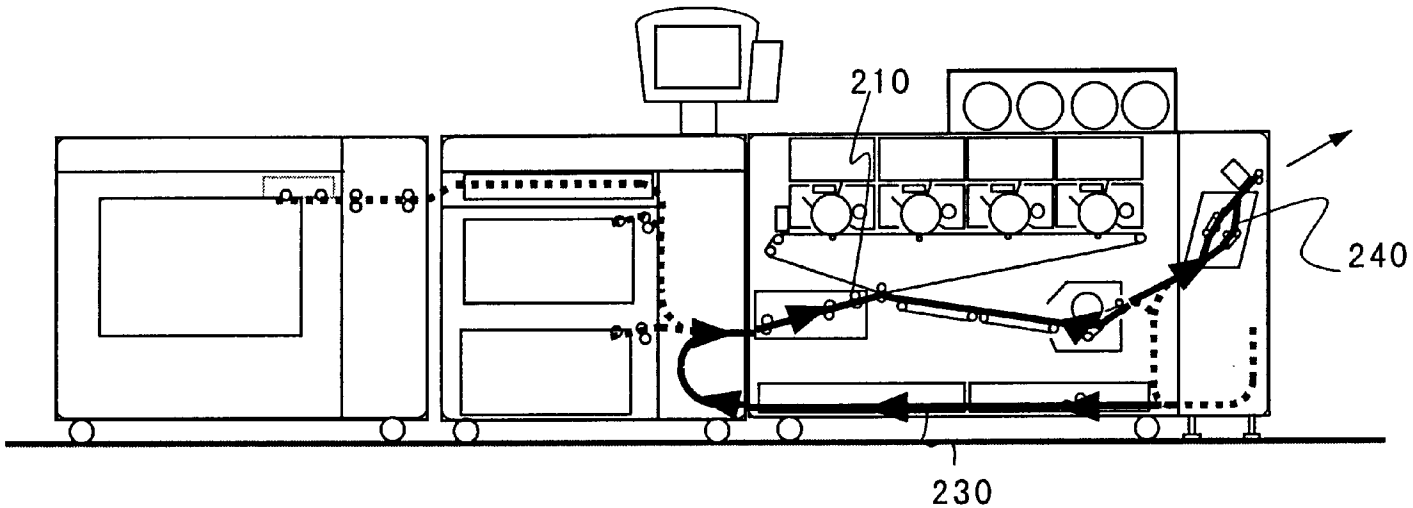

Referring to FIGS. 11A, 11B, and 11C used for explaining timing control in a duplex print mode, FIG. 11A shows the path along which the sheet is transported during upper surface print, FIG. 11B shows the path along which the sheet is transported during reverse surface print, and FIG. 11C shows selection rules for the control modes. Because in the duplex print mode the sheet is not inverted on the course from the main path 210 until the switch back path 220 for upper surface print indicated by the solid arrows in FIG. 11A, either one of the control modes A, B, and C is adopted according to the same selection rules as described above. In contrast to this, because the orientation of the sheet is reversed relative to its forward and backward directions on the course for reverse surface print from the switch back path 220 passing through the circulation path 230, the main path 210, and the output path 240 to be ejected shown by the solid arrows in FIG. 11B, the tab originally located on either the leading end or the trailing end of the sheet moves in an opposite manner after the sheet has been reversed. Accordingly, when the tab is located on either the leading end or the trailing end in a area which does not pass through the transport control sensor, the control mode B used before the reverse is switched to the control mode C after the reverse and the control mode C used before the reverse is switched to the control mode B after the reverse.

Up to this point, the selection rules for the control modes considering different orientations of the tab have been described with reference to FIGS. 9A–11C. It should be noted that, for a sheet without a tab, control mode A is always used regardless of print mode.

According to the present embodiment as described above, it is possible to appropriately determine each operation timing of the control-target devices, regardless of whether or not the sheet has a tab and regardless of the orientation of the tab as the sheet is loaded in the paper tray. Because a sheet with a tab may be loaded in the paper tray without constraints, the range of choices for apparatus such as a finisher is extended. Further, according to this embodiment, it is also possible to appropriately determine each operation timing of the control-target devices even when the sheet is inverted or upside down, such as required, for example, for duplex printing.

Still further, according to the present embodiment, the tab of the sheet fed from the paper tray is detected by the paper sensors A–F so as to determine the control mode to be used for controlling the subsequent operation timings according to the detected results. It is therefore possible to determine the timing of each operation of the devices using the control mode, appropriately selected on a sheet basis, even when sheets with and without tabs are mixed, or when the orientation of tabbed sheets loaded in one paper tray varies. By using the control modes according to the present embodiment, printed results with the sheets with tab inserted at the chapter breaks can be obtained, even by an image-forming apparatus having only one paper tray.

Because the checkpoints (the positions of the transport control sensors) on the paper path are aligned along one line parallel to the transport direction in the present embodiment, by determining the location of the tab at the beginning of paper feed, it is possible to obtain an advantage that processing is simplified by the elimination of judgment as to whether or not the tab moves on the line where the transport control sensors exists performed on a sensor-by-sensor basis. However, such an alignment is not required and the transport control sensors may be arranged in other patterns in a direction perpendicular to the transport direction. Even with such placement it is still possible to perform timing control as described above because determination of whether or not a tab traverses the transport control sensor on a sensor-by-sensor basis is possible as long as the location of each transport control sensor is known and the outputs are individually processed.

Figure 12:
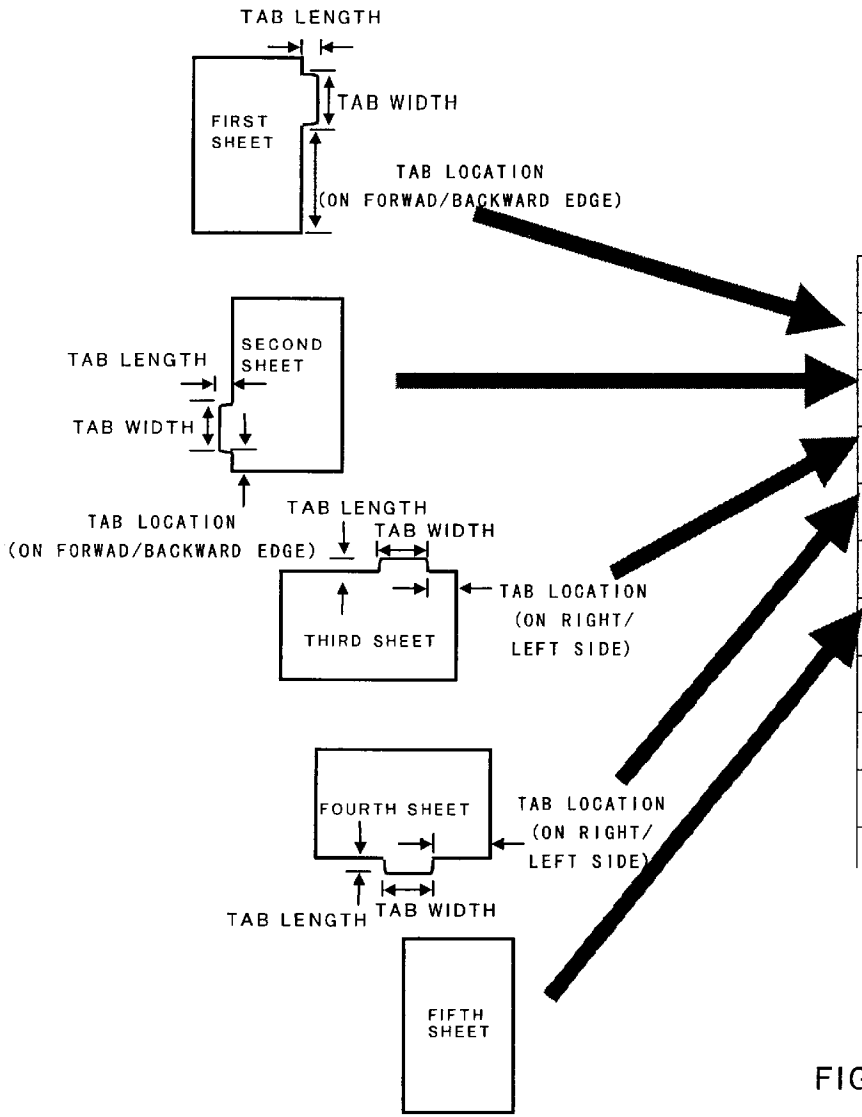
FIG. 12 is a drawing for explaining a configuration of tab information input by users.

Although in the above description the presence or absence of the tab, the length of the tab, and other features are detected by the paper sensors A–F, this information may input by users on a sheet-by-sheet basis. Users may input information such as whether or not a sheet has a tab and the tab location, length, and size (width) of any such tab, as shown in FIG. 12. In the case of manual input, the location of tab may be described using tab orientation of which side of the sheet has the tab relative to the transport direction and a distance from the reference edge of the sheet and the tab. The input information is stored in the image-forming apparatus as preference information for job. When a print job is initiated, tab information is sequentially retrieved from the stored preference information one by one so as to perform timing control according to the above-described processing based on the retrieved tab information.

Although in the above a preferred embodiment of the present invention has been described, it is to be understood that the embodiment is to be understood as one preferred example and the invention is not limited to the specific examples or the embodiment. It is therefore obvious that various changes and modifications may be made without departing from the spirit and scope of the invention.

What is claimed is:

1. An apparatus for control of transport of a sheet along a transport path comprising:

a tab information detector for obtaining information as to whether or not a tab lies on at least either one of the leading edge and the trailing edge of the sheet in a sheet transport direction, and information regarding the location of a tab detected on either the leading edge or the trailing edge of the sheet in a direction perpendicular to the sheet transport direction;

a sheet traverse detector installed on a checkpoint along the transport path for detecting the timing at which at least either one of the leading edge and the trailing edge of the transported sheet passes through the checkpoint; and a controller for determining operation timing of one or more control targets, wherein it is determined whether or not a tab is passing through the checkpoint based on the presence or absence of the tab detected by the tab information detector and relationship between the tab location and the position of the checkpoint in a direction perpendicular to the sheet transport direction so as to shift said operation timing of the control targets according to whether or not a tab is passing through the checkpoint.

2. An apparatus for control of transport of a sheet along a transport path according to claim 1, wherein said tab information detector comprises paper sensors, each of which is provided on either one of a plurality of positions established upstream from the checkpoint along the transport path in a direction perpendicular to the sheet transport direction, for detecting whether or not the sheet is present at the position of the sensor, and detects information as to whether or not a tab exists and the location of a detected tab in the direction perpendicular to the sheet transport direction based on detection of output signals of the paper sensors.

3. An apparatus for control of transport of a sheet along a transport path according to claim 2, wherein:

said tab information detector obtains a difference in timings of switching of level of output signal from said paper sensors, and said controller finds an amount of shifting of said operation timing from said difference in timings of switching.

4. An apparatus for control of transport of a sheet along a transport path according to claim 1, wherein said tab information detector accepts user input regarding the location of a tab on the edge of said sheet, and determines whether or not the tab lies on at least either one of the leading edge and the trailing edge in the sheet transport direction, and the location of the tab detected on either the leading edge or the trailing edge in the direction perpendicular to the sheet transport direction.

5. An apparatus for control of transport of a sheet along a transport path according to claim 1, wherein:

said tab information detector determines which of the leading edge and the trailing edge has the tab when information about the existence of a tab is obtained at said tab information detector, and said controller performs shifting control on said operation timing relative to the traverse timing of the leading edge of the sheet obtained at said sheet traverse detector when it is determined that the tab is located on the leading edge of the sheet or performs shifting control on said operation timing relative to the traverse timing of the trailing edge of the sheet obtained at the sheet traverse detector when it is determined that the tab is located on the trailing edge of the sheet.

6. An apparatus for control of transport of a sheet along a transport path according to claim 1, wherein said checkpoint is established on each of a plurality of different positions in the sheet transport direction on the transport path, the different positions which are aligned along a same line parallel to the transport path.

7. An apparatus for sheet transport control comprising:

a tab detector for detecting whether or not the sheet comprises a tab and, when a tab is detected, the location of the detected tab, and a controller including a plurality of control modes for sheet transport, said controller executing sheet transport according to a control mode corresponding to the presence or absence of the tab and the location of the tab detected by said tab detector.

8. An apparatus for sheet transport control comprising:

an tab orientation input interface for accepting input regarding which side of the sheet has a tab, and a controller having a plurality of control modes for sheet transport, said controller executing sheet transport according to a control mode corresponding to the user input accepted in said tab orientation input interface.

9. An apparatus for controlling transport of a tabbed sheet comprising:

a tab location detector for obtaining information regarding the location of a tab in a direction perpendicular to a sheet transport direction;

a sheet traverse detector provided along a transport path for detecting at least either one of the leading edge and the trailing edge of the transported sheet so as to find traverse of the transported sheet; and a setting apparatus for establishing a transport control timing for transporting said sheet based on relationship between the tab location detected by said tab location detector and a position of said sheet traverse detector in the direction perpendicular to the sheet transport direction.

10. An apparatus according to claim 9, wherein said tab location detector comprises a plurality of sensors provided upstream from said sheet traverse detector along the transport path and aligned along a line perpendicular to the sheet transport direction, and detects information regarding the tab location based on the output of the sensors.

11. An apparatus according to claim 10, wherein said setting apparatus establishes a transport control timing for transporting said sheet based on a relationship between the tab location detected by said tab location detector and the position of said sheet traverse detector in the direction perpendicular to the sheet transport direction, and based on a difference in timings of sheet detection by a plurality of said sensors.

12. An apparatus according to claim 9, further comprising a tab orientation determining means for determining information about the orientation of a tab, wherein said setting apparatus establishes a transport control timing for transporting said sheet based on a relationship between the tab location detected by said tab location detector and the position of said sheet traverse detector in the direction perpendicular to the sheet transport direction and based on the tab orientation determined by said tab orientation determination means.

13. A method for control of transport of a sheet along a transport path comprising the steps of:

(a) obtaining information as to whether or not a tab lies on at least either one of the leading edge and the trailing edge of a sheet, and information regarding the location of any such tab present on either the leading edge or the trailing edge of the sheet in a direction perpendicular to the sheet transport direction;

(B) detecting traverse timing that at least either one of the leading edge and the trailing edge of the transported sheet passes through a checkpoint through the use of a sheet traverse detector provided on the checkpoint established on the transport path;

(C) determining operation timing of one or more control targets based on the traverse timing detected by the sheet traverse detector, wherein, by determining whether or not the tab traverses the checkpoint according to the obtained information about the presence or absence of the tab and a relationship between the tab location and the position of the checkpoint in a direction perpendicular to the sheet transport direction, said operation timing of the control targets is shifted depending on whether or not a tab is traversing the checkpoint.

14. A method for controlling a tabbed sheet comprising the steps of:

obtaining information regarding a tab location in a direction perpendicular to a sheet transport direction;

detecting traverse of the sheet by sensing at least either one of the leading edge and the trailing edge of the transported sheet through the use of a sheet detector provided along a transport path; and, when the traverse of the sheet is detected, establishing a transport control timing suitable for transporting said sheet based on a relationship between the detected tab location and the position of said sheet traverse detector in the direction perpendicular to the sheet transport direction.

15. A method for controlling a tabbed sheet according to claim 14, wherein said step of obtaining information regarding a tab location obtains information about a tab location from the output of a plurality of sensors installed upstream from said sheet traverse detector along the transport path and aligned in a direction perpendicular to the sheet transport direction.

16. A method for controlling a tabbed sheet according to claim 15, wherein said step of establishing the transport control timing establishes the transport control timing necessary for transporting said sheet based on a relationship between said tab location and the position of said sheet traverse detector in the direction perpendicular to the sheet transport direction and a difference in timings detected by a plurality of said sensors.

17. A method for controlling a tabbed sheet according to claim 14, further comprising:

a step of obtaining information regarding the orientation of the tab relative to the sheet transport direction, wherein said step of establishing the transport control timing establishes a transport control timing suitable for transporting said sheet based on relationship between said tab location and the position of said sheet traverse detector in the direction perpendicular to the sheet transport direction, and based on the orientation of the tab.

* * * * *